US007277668B2

(12) United States Patent
Kojima

(10) Patent No.: US 7,277,668 B2
(45) Date of Patent: Oct. 2, 2007

(54) SHEET FEEDING UNIT AND IMAGE FORMING APPARATUS

(75) Inventor: Ryuichi Kojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 11/038,207

(22) Filed: Jan. 21, 2005

(65) Prior Publication Data

US 2005/0163548 A1 Jul. 28, 2005

(30) Foreign Application Priority Data

Jan. 23, 2004 (JP) ..... 2004-015231

(51) Int. Cl.
*G03G 15/00* (2006.01)
*B65H 3/00* (2006.01)
*B65H 3/06* (2006.01)

(52) U.S. Cl. ..... 399/393; 399/388; 271/8.1; 271/117

(58) Field of Classification Search ..... None
See application file for complete search history.

(56) References Cited

U.S. PATENT DOCUMENTS 5,927,702 A 7/1999 Ishii et al. ..... 271/9.09
6,070,867 A 6/2000 Tsurumi et al. ..... 271/114
6,260,840 B1 * 7/2001 Suga et al. ..... 271/10.12
6,308,947 B1 10/2001 Kojima et al. ..... 271/124
6,375,183 B1 4/2002 Inoue et al. ..... 271/10.11
6,502,816 B2 1/2003 Inoue et al. ..... 271/121
6,769,680 B2 8/2004 Kojima et al. ..... 271/117

FOREIGN PATENT DOCUMENTS

JP 2001-010160 1/2001

* cited by examiner

*Primary Examiner*—Judy Nguyen
*Assistant Examiner*—N. Ha
(74) *Attorney, Agent, or Firm*—Fitzpatrick, Cella, Harper & Scinto

(57) ABSTRACT

A sheet feeding unit according to the invention includes a sheet stacking tray on which the sheet is stacked, a sheet feeding device which feeds the sheet stacked on the sheet stacking tray, and a unit frame which supports the sheet stacking tray and the sheet feeding portion and is attached to a apparatus main body. In the sheet feeding unit, the sheet feeding device is pivotable on the unit frame to change a sheet feeding direction.

7 Claims, 17 Drawing Sheets

(RELATED BACKGROUND ART)

SHEET FEEDING UNIT AND IMAGE FORMING APPARATUS

BACKGROUND OF THE INVENTION

1. Field of the Invention

The present invention relates to a sheet feeding unit which is used in an image forming apparatus such as a copying machine, a laser beam printer, and a facsimile.

2. Description of Related Art

In the image forming apparatus such as the copying machine and the laser beam printer, a plurality of sheet trays are arranged in a sheet feeding portion, and each of sheets having the different sizes and types is stored in each sheet tray. The corresponding sheet stored in the sheet tray is fed according to the size of an original, magnification and reduction rates, and the like. In addition to the sheet trays in which fixed type of sheet are stored, generally a manual sheet feed tray is further arranged in a side portion of the apparatus main body in the image forming apparatus. Namely, a mechanism which can feed a small number of special sheets, a special type of sheet which cannot be stored in the sheet tray like an OHP sheet, a thick sheet such as a post card, and the like is provided in the image forming apparatus.

For example, as disclosed in Japanese Patent Application Laid-Open No. 2001-010160, the manual sheet feed tray includes a sheet feeding device which generally separates and feeds the plurality of sheets stacked on the manual sheet feed tray one by one.

Recently, in the image forming apparatus, there is a demand that the common mechanism is unitized and commonly used for the different image forming apparatuses. When the similar mechanism is formed as a common unit, there are advantages in reduction of production cost, reuse property of the common unit, supply of maintenance parts, and the like.

Because the manual sheet feed tray is common in the mechanism in which the small number of special sheet is fed to the apparatus, that the manual sheet feed tray is unitized as a sheet feeding unit and commonly used among the different image forming apparatuses is beginning to become widespread.

However, in the image forming apparatus including a manual sheet feed tray 101, there are two types of sheet conveyance paths. Namely, in the sheet conveyance path immediately after a sheet conveyance path through which the sheet is conveyed from the manual sheet feed tray 101 to an apparatus main body (hereinafter referred to as manual sheet feed path 102) is merged into a sheet conveyance path on the side of the apparatus main body (hereinafter referred to as main body path), the case in which the sheet conveyance path is parallel to the manual sheet feed path 102 as shown in FIG. 16A hereinafter referred to as parallel path 104) and the case in which the sheet conveyance path is perpendicular to the manual sheet feed path 102 as shown in FIG. 16B (hereinafter referred to as vertical pass 105) exist.

For example, when the manual sheet feed tray 101 is produced according to the parallel path 104, a sheet separation roller pair 106 is arranged so that a direction of a nip line of the sheet separation roller pair 106 becomes parallel to the parallel path 104 (see FIG. 16A). When the manual sheet feed tray 101 is unitized and used as a sheet feeding unit 100 to the image forming apparatus with the vertical path 105, an angle between the vertical path 105 and the direction of the nip line of the sheet separation roller pair 106 becomes substantially 90° (see FIG. 16C). Therefore, when the sheet is conveyed so that the sheet is transferred from the manual sheet feed path 102 to the vertical path 105, the sheet is conveyed while largely curved by the conveyance path. Namely, the fed sheet is largely bent in a merging portion of the manual sheet feed path 102 and the vertical path 105. Because sometimes the manual sheet feed tray 101 feeds the special sheet, when the sheet is largely bent in feeding the thick sheet having high rigidity, the sheet is largely damaged, or conveyance failure is generated due to the high rigidity of the sheet.

When the manual sheet feed tray 101 is produced according to the vertical path 105, the sheet separation roller pair 106 is arranged so that the direction of the nip line of the sheet separation roller pair 106 becomes oblique with respect to the vertical path 105 (see FIG. 16B). When the manual sheet feed tray 101 produced according to the vertical path 105 is unitized and used as a sheet feeding unit 1000 to the image forming apparatus with the parallel path 104, it is necessary that the manual sheet feed path 102 is largely bent to merge the manual sheet feed path 102 into the parallel path 104 (see FIG. 16D). Therefore, as with the above-described case, when the thick sheet having high rigidity is fed from the manual sheet feed tray, the sheet is largely damaged.

SUMMARY OF THE INVENTION

An object of the invention is to provide a sheet feeding unit, which can commonly be used for the image forming apparatus with the parallel path and the image forming apparatus with the vertical path, and can maintain sheet feeding performance without damaging the sheet when the sheet feeding unit is used in either the image forming apparatus with the parallel path or the image forming apparatus with the vertical path.

In order to solve the problem, a sheet feeding unit of the invention which is attached to an apparatus main body to feed a sheet to the apparatus main body, the sheet feeding unit including a sheet stacking tray on which the sheet is stacked, a sheet feeding device which feeds the sheet stacked on the sheet stacking tray, and a unit frame which supports the sheet stacking tray and the sheet feeding portion and is attached to the apparatus main body, wherein the sheet feeding device is pivotably supported on the unit frame to change a sheet feeding direction.

DESCRIPTION OF PREFERRED EMBODIMENT

First Embodiment

Description of Configuration

Referring to FIGS. 1 to 9 and 17, a first embodiment of a sheet feeding unit according to the invention and an image forming apparatus with the sheet feeding unit will be described below.

Figure 2:
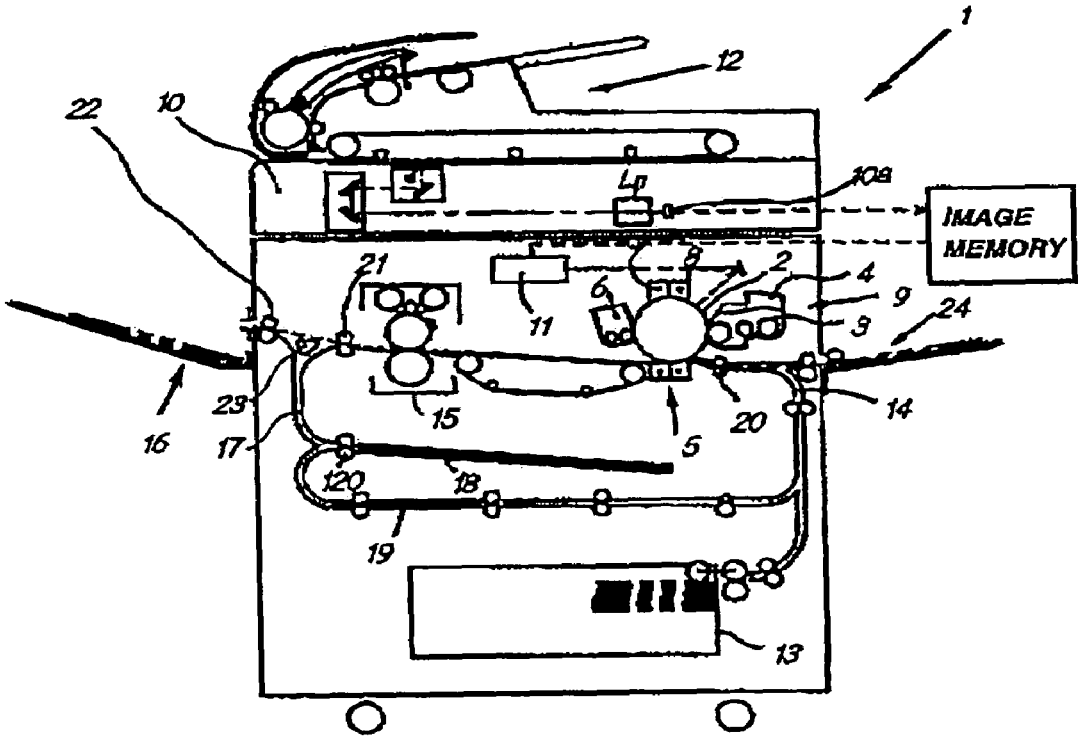
FIG. 2 is a sectional view showing a schematic configuration of an electrophotographic copying machine which is of an image forming apparatus.

First an overall configuration of an image forming apparatus 1 will be described referring to FIG. 2. FIG. 2 is a sectional view showing a schematic configuration of an electrophotographic copying machine which is of the image forming apparatus. As shown in FIG. 2, the image forming apparatus 1 includes an image bearing member 2 (for example, a drum-shaped electrophotographic photosensitive member or a belt-shaped electrophotographic photosensitive member), a development device 3 which visualizes a latent image by causing a developer to adhere to the latent image formed on the image bearing member 2 (namely, the latent image is developed), a hopper unit 4 which transports the developer (in the embodiment, developer is one-component-system magnetic toner) to the development device 3, transfer means 5 which transfers the developed image visualized on the image bearing member 2 to the sheet (recording medium), a cleaning device 6 which removes the developer remaining on the image bearing member 2 and other adherents, charge removal means 7 which removes a residual charge of the image bearing member 2, and a primary charging device 8 which evenly charges a surface of the image bearing member 2. An image forming unit 9 shall include the image bearing member 2, the development device 3, the hopper unit 4, the transfer means 5, the cleaning device 6, the charge removal means 7, and the primary charging device 8.

An image reading unit includes an optical reading system 10 which reads image information of the original, CCD 10*a* which reads the image information, and an exposure unit 11 which exposes the image information on the image bearing member 2 to form the latent image. The image reading unit also includes an original processing device 12 which introduces the original to the image reading unit, a sheet stacking and feeding unit 13 which feeds a sheet P to the image forming unit 9, a main body path 14 through which the sheet P is conveyed, a fixing device 15 which fixes the image (developer image) transferred to the image forming unit 9 to the sheet P, a sheet discharge unit 16 which discharges the sheet in which the image formation is completed, a re-feeding path 17 which introduces the sheet to be re-fed in two-sided copy, a reversal path 18 which reverses the sheet to be re-fed, and a two-side path 19 which conveys the reversed sheet to the development device.

Sheet conveyance means includes a registration roller 20 which is arranged on the upstream side of the image bearing member 2 and conveys the sheet to the image bearing member 2, an inner discharge roller 21 which conveys the post-fixing sheet, an outer discharge roller 22 which discharges the sheet to the sheet discharge unit 15, and a discharge unit flapper 23 which switches the sheet feeding path between the sheet discharge unit 16 and the re-feeding path 17. A sheet feeding unit 24 is further arranged in a side portion of the apparatus for feeding special sheets like an OHP sheet or a thick sheet to the image forming unit.

Figure 1:
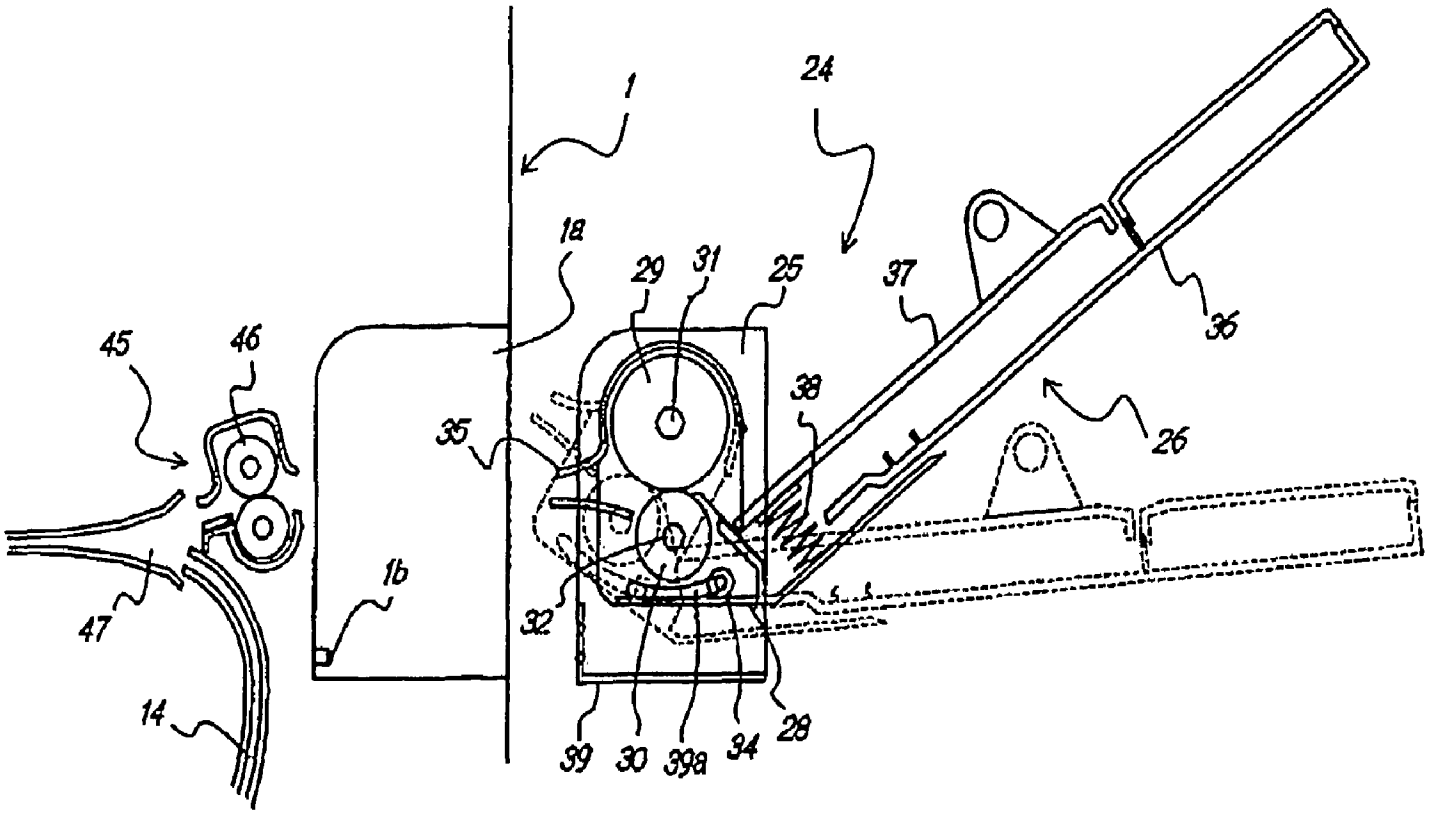
FIG. 1 is a schematic sectional view showing a sheet feeding unit.
Figure 3:
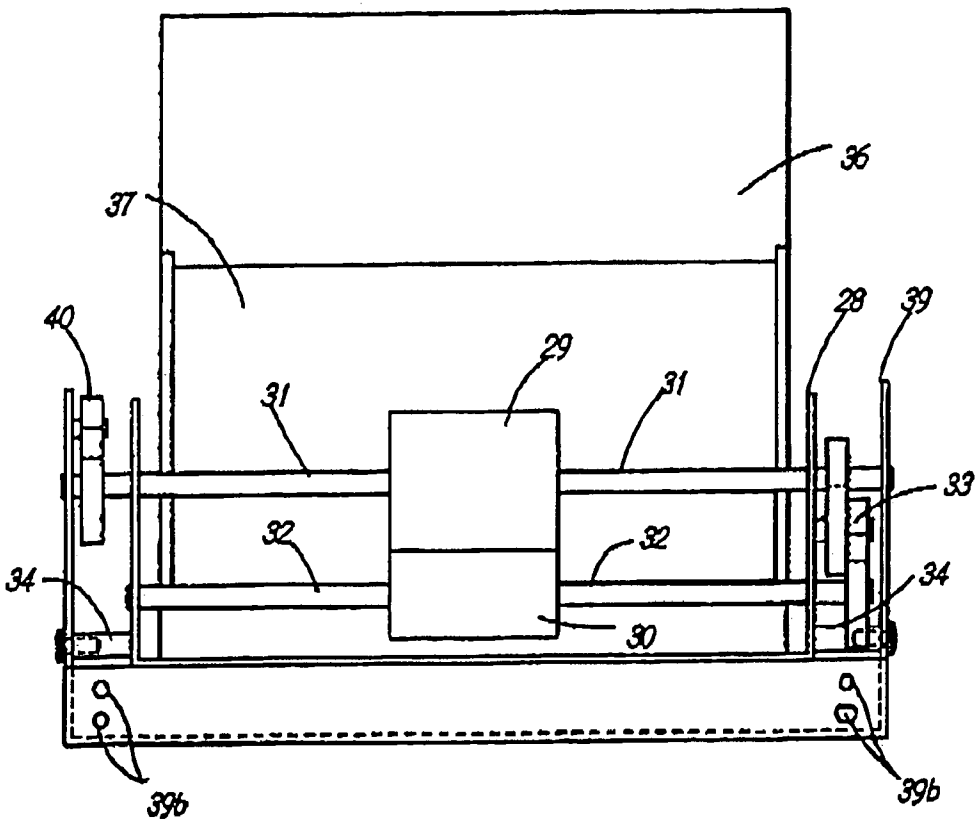
FIG. 3 is a plan view showing the sheet feeding unit.
Figure 4:
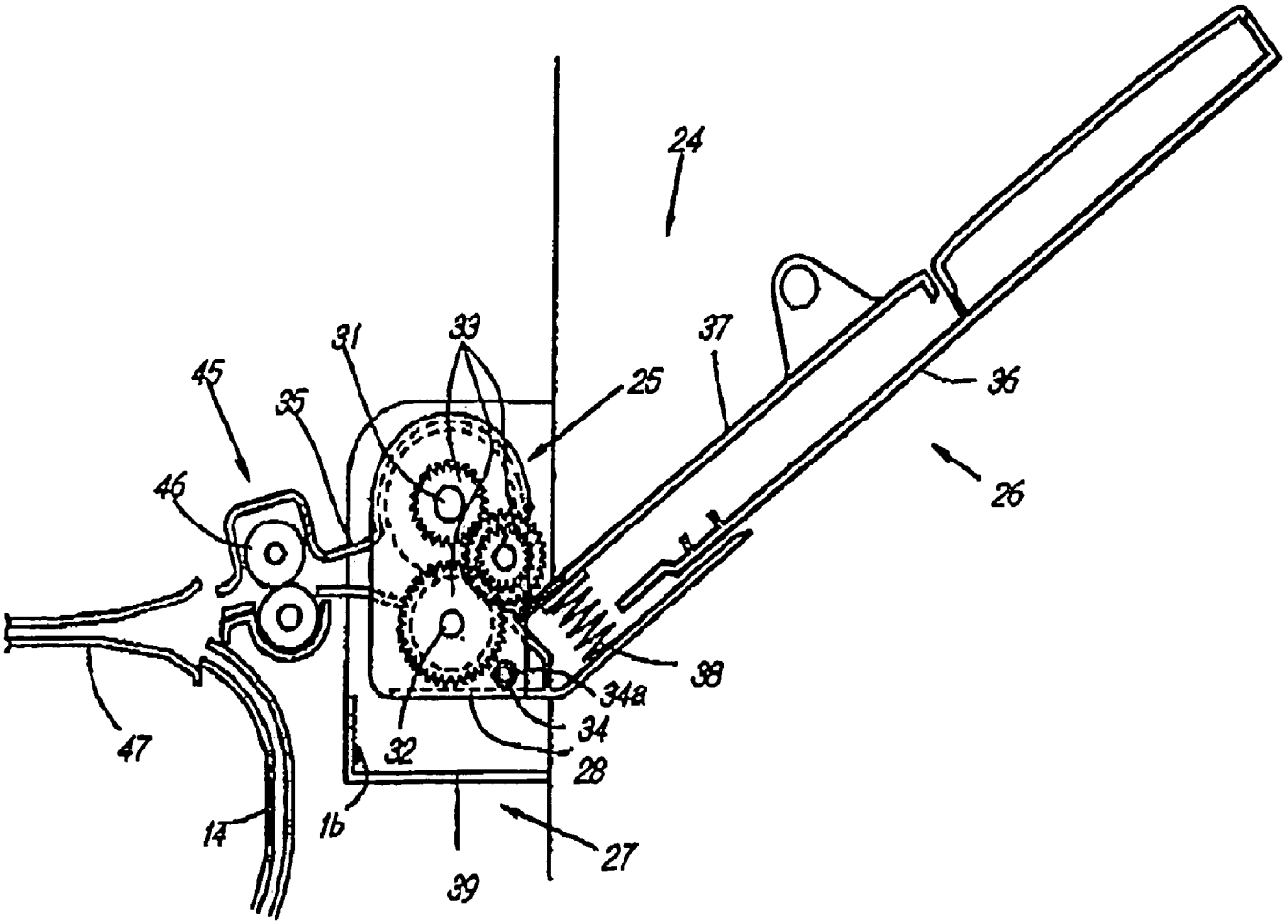
FIG. 4 is a sectional view for explaining a gear train.
Figure 5:
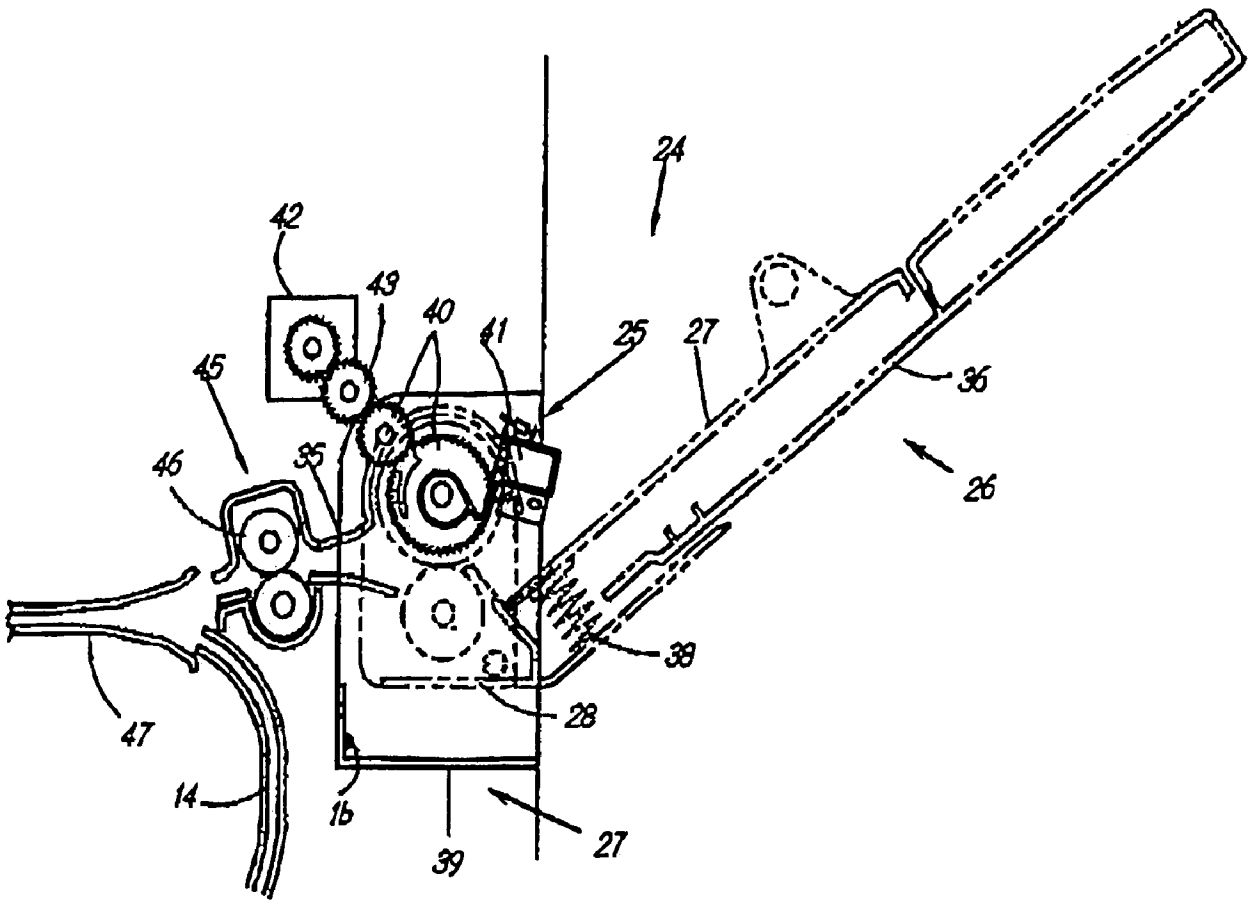
FIG. 5 is a sectional view for explaining a gear train.

Then, a configuration of the sheet feeding unit 24 will be described referring to FIGS. 1 and 3 to 5. FIG. 1 is a schematic sectional view showing the sheet feeding unit, FIG. 3 is a front elevation showing the sheet feeding unit, and FIGS. 4 and 5 are a sectional view for explaining a gear train. The sheet feeding unit 24 includes sheet feeding device 25 which is of an example of sheet feeding means, a tray unit 26 which is of an example of sheet stacking means, and a unit fame portion 27.

The sheet feeding device 25 includes a sheet feeding device frame 28, a feed roller 29 and a retarding roller (separating member) 30 which separate and feed the sheet, a feed roller shaft 31, a retarding roller shaft 32, a gear train 33 (see FIG. 4), a fixing pin 34 which fixes the sheet feeding device 25 to a unit frame 39, and a sheet guide 35. The feed roller shaft 31 is integrally rotated with the feed roller 29, and the feed roller shaft 31 is pivotably supported on the sheet feeding unit frame 28. The retarding roller shaft 32 is integrally rotated with the retarding roller 30, and the retarding roller shaft 32 is pivotably supported on the sheet feeding unit frame 28. When the feed roller 29 is rotated, the gear train 33 rotates the retarding roller 30 in an opposite rotating direction to the feed roller in synchronization with the rotation of the feed roller 29. The sheet guide 35 guides the sheet to a conveyance path provided in the apparatus main body after the sheet is separated and fed by the feed roller 29 and the retarding roller 30 which are of a sheet feed rotating member. A screw hole 34*a* which fixes the fixing pin 34 to the unit frame 39 is arranged in the fixing pin 34.

The sheet is stacked on the tray unit 26 which is of a sheet stacking tray of the invention. The tray unit 26 includes a sheet tray 36, an intermediate plate 37, and an intermediate plate biasing spring 38. The intermediate plate 37 is pivotable on a rotating axis with respect to the sheet tray 36. The intermediate plate biasing spring 38 biases the intermediate plate 37 toward the direction in which the intermediate plate 37 is pressed against the feed roller 29. The tray unit 26 is integrally fixed to the sheet feeding device 25.

The unit frame portion 27 includes the unit frame 39 which supports the tray unit 26 and the sheet feeding device 25, a gear train 40 (see FIG. 5) which rotates feed roller 29, and a solenoid 41. The solenoid 41 is turned on and off by a signal from the apparatus main body, and the solenoid controls the feed roller 29 so that the feed roller 29 is rotated one turn by the signal from the apparatus main body. The feed roller shaft 31 of the sheet feeding device 25 is pivotably supported in the unit frame 39. The sheet feeding device 25 which is of the sheet feeding means is pivotably supported about the rotating axis of the feed roller 29 on the unit frame 39. Since the sheet feeding device 25 is pivotably supported on the unit frame 39, the direction of the sheet fed from the sheet feeding unit 24 to the apparatus main body can be changed. As described above, since the tray unit 26 is integrally fixed to the sheet feeding device 25, the sheet feeding device 25 and the tray unit 26 are integrally rotated with respect to the unit frame 39.

Figure 7:
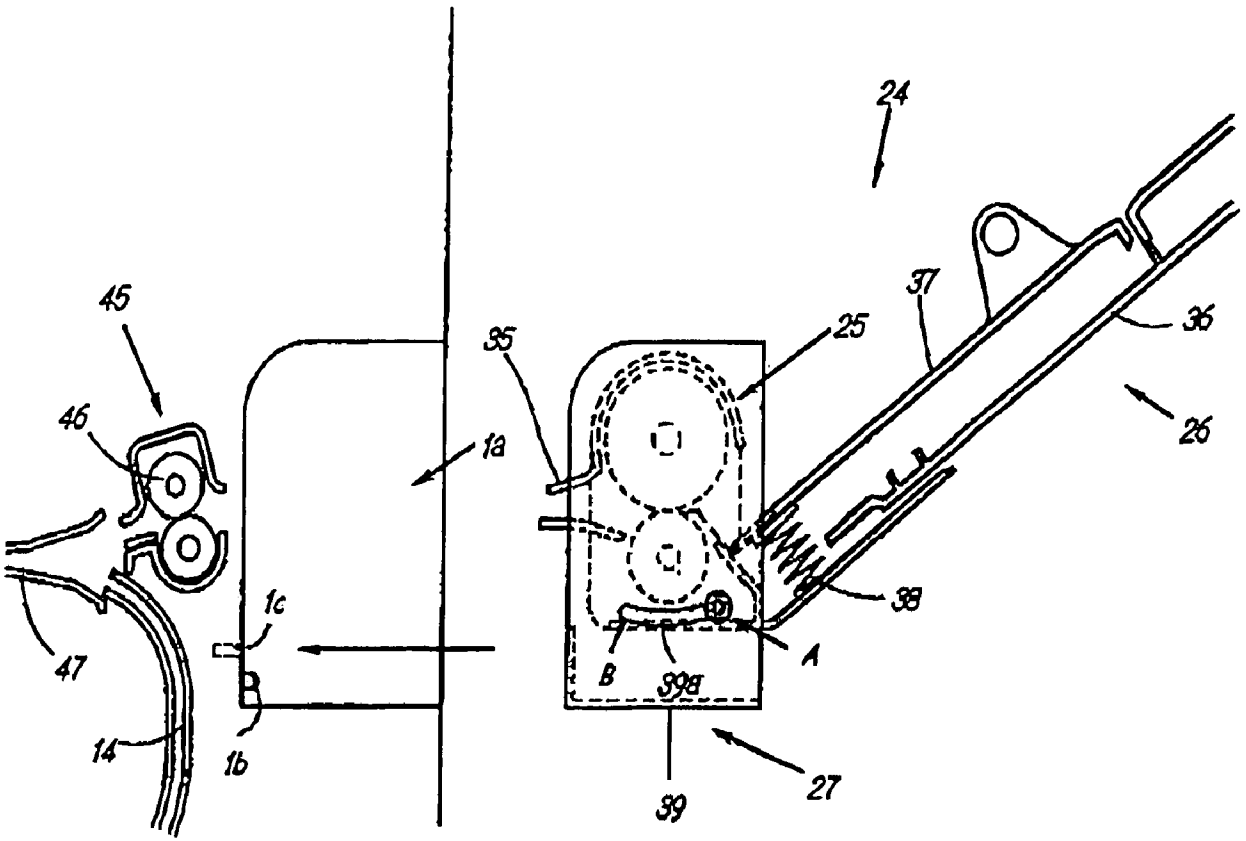
FIG. 7 is a view for explaining a state before the sheet feeding unit is attached.

In both side-plates of the unit frame 39, a substantially arc slit 39*a* is provided at a position corresponding to the fixing pin 34 so that the sheet feeding device 25 can be fixed to the unit frame 39 at an arbitrary angle (see FIG. 7). The unit frame 39 and the sheet feeding device 25 can be fixed to each other by a screw while the rotating angle of the sheet feeding device 25 is set to a predetermined angle with respect to the unit frame 39. Namely, the fixing pin 34 and the slit 39*a* constitute a fixing unit which fixes the sheet feeding device 25 to the unit frame 39 at an arbitrary angle or a predetermined angle. Outside faces of the unit frame 39 act as a connection unit to the apparatus main body, and holes 39*b* are made in the unit frame 39 in order to position the unit frame 39 to a predetermined position in the apparatus main body (see FIG. 3).

Figure 6:
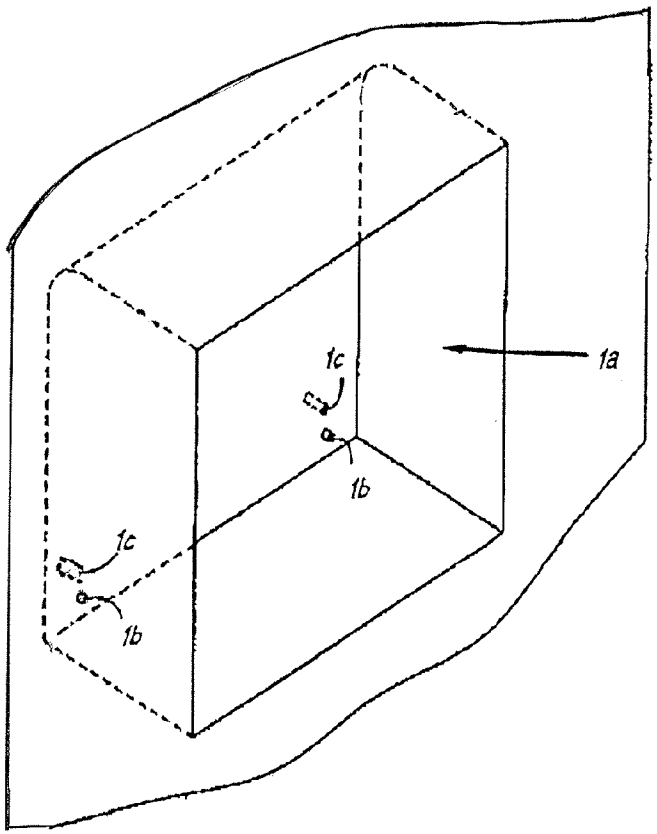
FIG. 6 is a view for explaining a sheet feeding unit attaching configuration of an apparatus main body.

The configuration for attaching the sheet feeding unit 24 on the apparatus main body side will be described below referring to FIG. 6. FIG. 6 is a view for explaining the sheet feeding unit attaching configuration of the apparatus main body.

An insertion port 1*a* into which the sheet feeding unit 24 is inserted is formed in the apparatus main body. Bosses 1*b* for positioning the unit frame 39 and screw holes 1*c* for fixing the unit frame 39 are arranged in the back of the insertion port 1*a*. A drive transmission gear 43 and a motor 42, are arranged in the apparatus main body. The drive transmission gear 43 is an example of a drive transmission member which engages the gear train 40 when the sheet feeding unit 24 is inserted into the apparatus main body. The motor 42 is a drive source which drives the feed roller 29 through the gear train 40 and the drive transmission gear 43. A manual sheet feed path 45 is arranged at the position corresponding to the sheet guide 35 of the apparatus main body. The manual sheet feed path 45 merges the sheet fed from the sheet feeding unit 24 into the main body path 14. A conveyance roller pair which conveys the sheet is arranged in the manual sheet feed path 45.

The sheet conveyance path, in which the sheet conveyance path is parallel to the manual sheet feed path 45 immediately after the manual sheet feed path 45 is merged into the main body path 14, is set to a parallel path 47. The sheet conveyance path, in which the sheet conveyance path is perpendicular to the manual sheet feed path 45 immediately after the manual sheet feed path 45 is merged into the main body path 14, is set to a vertical path 48 (see FIG. 9).

Description of Action

The action of the image forming apparatus will be described below. The original is loaded on an original base plate glass 10*b*. Alight image according to the image information is focused on CCD 10*a* with a plurality of mirrors M and lenses Ln in the optical reading system 10, and CCD 10*a* reads the image information. The exposure unit 11 focuses the image information which is read by laser beam on the image bearing member 2. Among recording materials (hereinafter referred to as "sheet P") stacked on the sheet stacking and feeding unit 13, a proper sheet is selected from sheet size information on the sheet stacking and feeding unit 13 on the basis of information inputted from an operation unit by a user or sheet sizes of the original.

One sheet P fed from the sheet stacking unit 13 is conveyed to the registration roller 20 through the main body path 14, and the sheet P is conveyed while the rotation of the image bearing member 2 is synchronized to timing of scan of the exposure unit 11. A toner image which is formed on the image bearing member 2 by the transfer charger of the transfer means 5 is transferred to the sheet P, and the sheet P to which the toner image is transferred is separated from the image bearing member 2 by a separation charger.

Then, in the sheet P, the toner image is fixed onto the sheet by heat and pressure in the fixing device 15. In the case of one-side copy, after the sheet P passes through the inner discharge roller 21, and the sheet P is discharged to the sheet discharge unit 16 by the outer discharge roller 22. In the case of the two-side copy, the sheet P is temporarily conveyed to the reversal path 18 through the re-feeding path 17 by control of the discharge unit flapper 23. At this point, the sheet P is conveyed into the apparatus again by reversing reversal rollers 120 at timing when a backend of the sheet P passes through the re-feeding path 17 and is held between the reversal rollers 120. After the sheet P is conveyed to the registration roller 20 through the two-side path 19 again, the sheet P is discharged to the sheet discharge unit 16 by passing through the same path as in the case of the one-side copy.

When the sheet is placed on the sheet feeding unit 24, the user selects a manual sheet feed mode with the operation unit, or the apparatus automatically changes the mode to the manual sheet feed mode by detecting the placement of the sheet on the sheet feeding unit 24, which allows the sheet to be conveyed into the apparatus main body by the sheet feeding device of the sheet feeding unit 24. Then, the sheet is discharged to the sheet discharge unit 16 through the same path as in the case of the one-side copy.

Then, Attachment of the sheet feeding unit 24 to the apparatus main body will be described referring to FIGS. 7 to 9. FIG. 7 is a view for explaining a state before the sheet feeding unit is attached, FIG. 8 is a view for explaining the state in which the sheet feeding unit is attached to a parallel path device, and FIG. 9 is a view for explaining the state in which the sheet feeding unit is attached to a vertical path device.

In the sheet feeding unit 24, because the direction of a nip line between the feed roller 29 and the retarding roller 30 is changed according to the rotating angle of the sheet feeding device 25 with respect to the unit fame 39, the direction of the sheet feed performed by the feed roller 29 and the retarding roller 30 depends on the rotating angle. The sheet feeding unit 24 can be attached to a plural type of a apparatus main body. The sheet feeding device 25 is held at an angle with respect to the unit frame 39 according to each type of the apparatus main body.

The case in which the sheet feeding unit 24 is attached to the image forming apparatus with the parallel path like the image forming apparatus shown in FIG. 2 will be described. As shown in FIG. 7, the fixing pin 34 of the sheet feeding device 25 is positioned (position of A in FIG. 7) so that the direction of the nip line between the feed roller 29 and the retarding roller 30 becomes substantially horizontal. In this state, the fixing pin 34 is fixed to the unit frame 39 with the screw.

Figure 8:
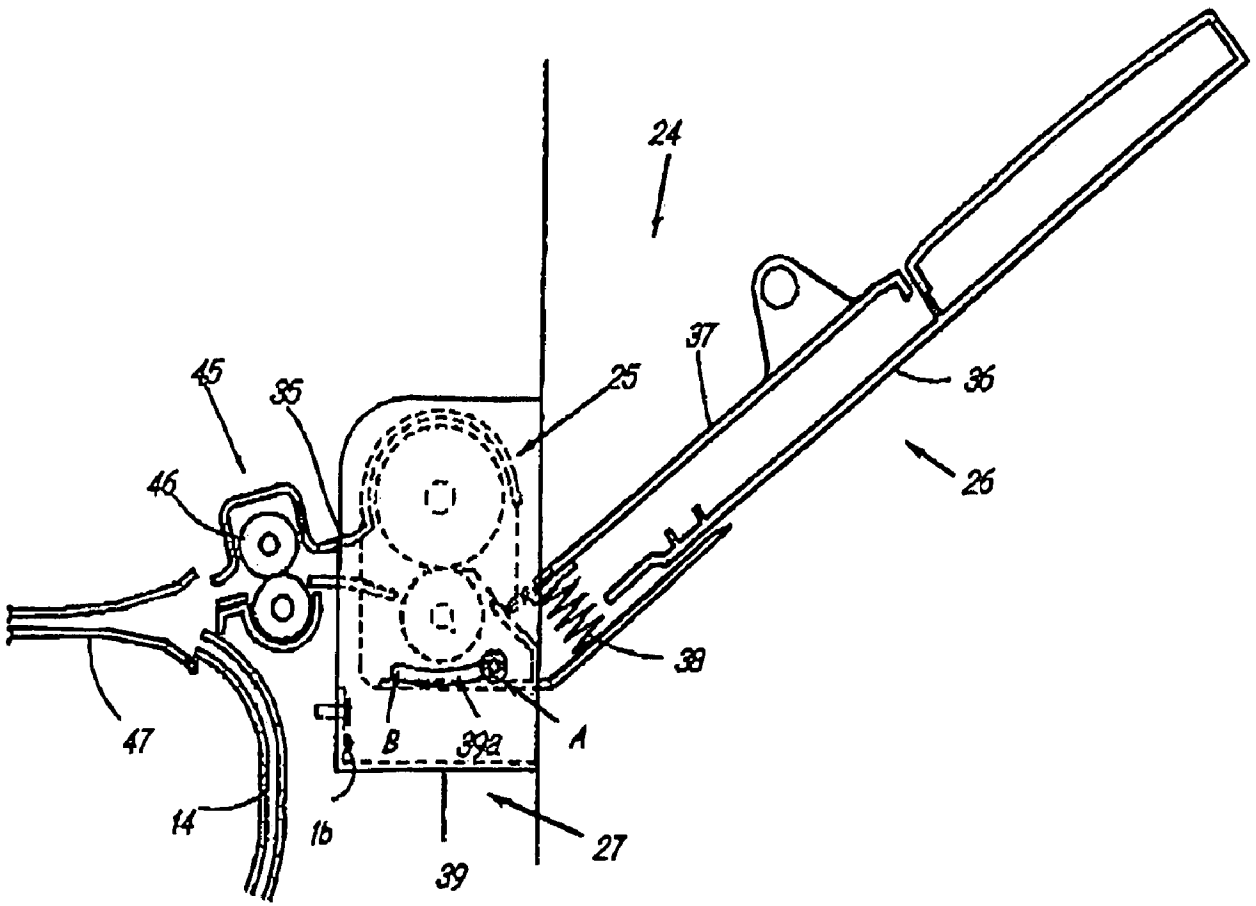
FIG. 8 is a view for explaining a state in which the sheet feeding unit is attached to a parallel path device.
Figure 9:
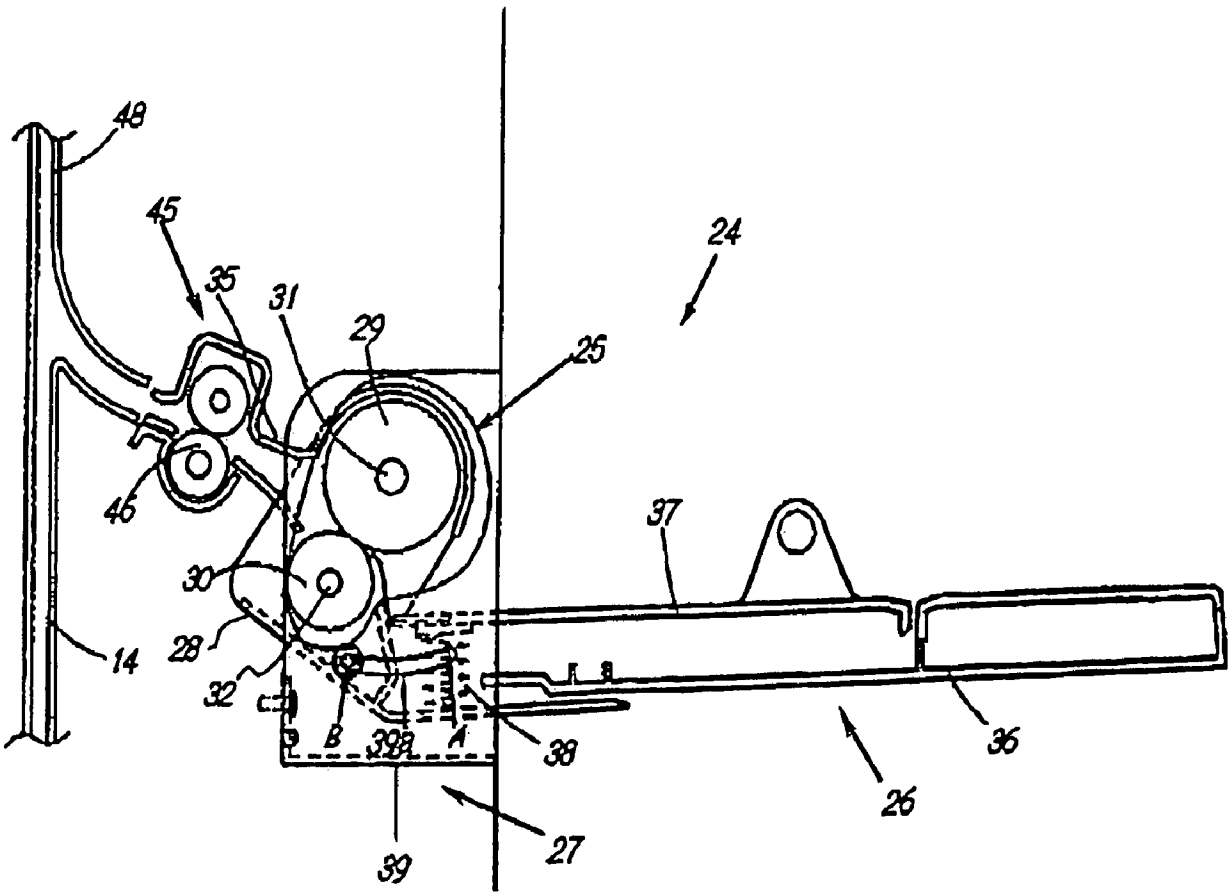
FIG. 9 is a view for explaining a state in which the sheet feeding unit is attached to a vertical path device.

As shown in FIG. 8, the sheet feeding unit 24 is inserted into the apparatus main body. The sheet feeding unit 24 is positioned to the apparatus main body by fitting the bosses 1*b* provided in the back of the insertion port 1*a* of the apparatus main body to the holes 39*b* made in the unit frame 39 of the sheet feeding unit 24. Then, the sheet feeding unit 24 is fixed to the apparatus main body through the screw holes 1*c* with the screws.

At this point, the direction of the nip line between the feed roller 29 and the retarding roller 30 becomes substantially in line with the manual sheet feed path 45 and the post-merging parallel path 47. In this case, the drive gear 43 arranged in the apparatus main body engages the gear train 40 which drives the feed roller 29 of the sheet feeding unit 24 (see FIG. 5), and the feed roller 29 and the like are rotated by the signal from the apparatus main body. As used herein, the nip line between the feed roller 29 and the retarding roller 30 shall mean a tangent line at the position where the feed roller 29 comes into contact with the retarding roller 30.

Figure 17:
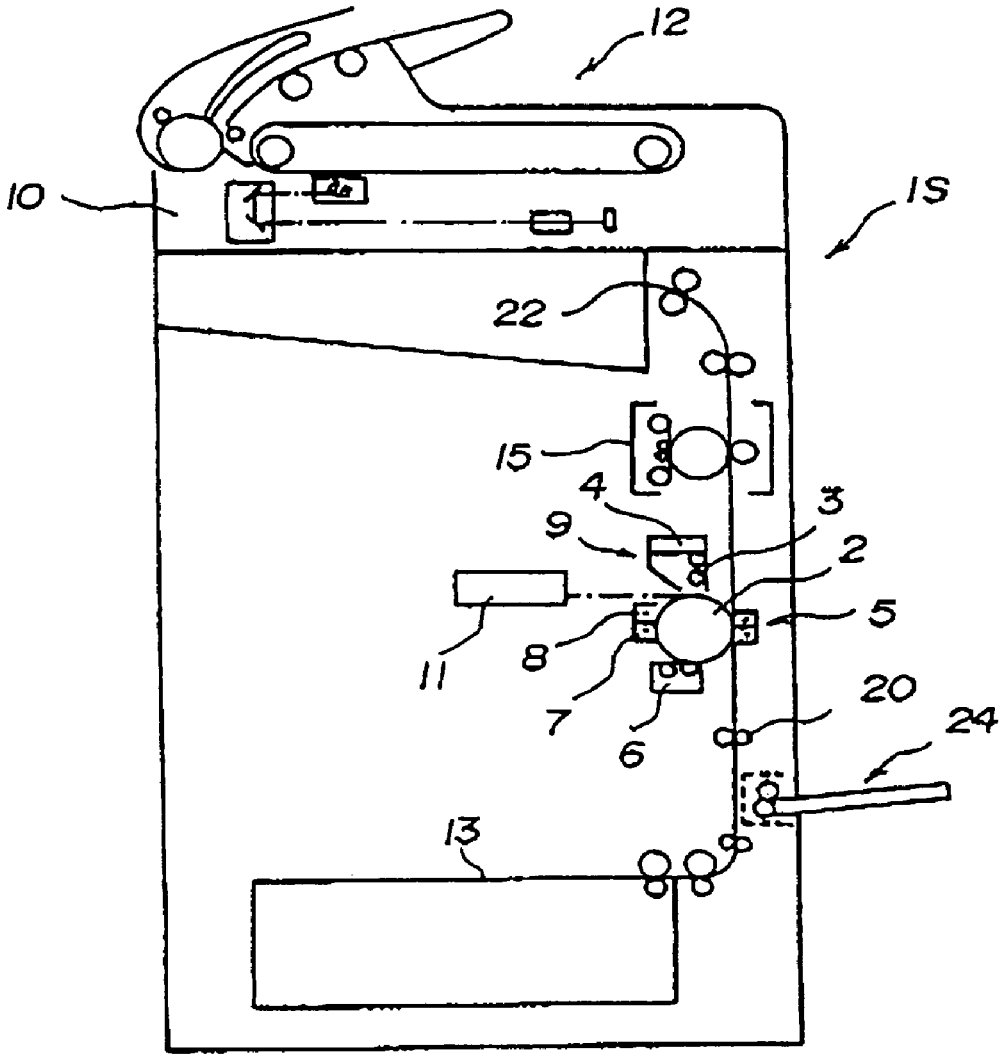
FIG. 17 is a sectional view showing the image forming apparatus with a vertical path.

The case in which the sheet feeding unit 24 is attached to an image forming apparatus 1S whose conveyance path is the vertical path will be described below. The conveyance path receives the sheet from the sheet feeding unit 24 as shown in FIG. 17. The image forming apparatus 1S shown in FIG. 17 differs from the image forming apparatus 1 shown in FIG. 2 only in a path shape, so that the member having the same function as the image forming apparatus 1 shown in FIG. 2 is indicated by the same reference numeral, and the description the member is omitted. When the sheet feeding unit 24 is attached to the apparatus main body with the vertical path, as shown in FIG. 9, the fixing pin 34 of the sheet feeding device 25 is positioned (position of B in FIG. 9) so that the direction of the nip line between the feed roller 29 and the retarding roller 30 becomes oblique. In this state, the fixing pin 34 is fixed to the unit frame 39 with the screw.

The sheet feeding unit 24 is inserted into the apparatus main body to fix the sheet feeding unit 24 to the apparatus main body with the screw. At this point, since the direction of the nip line between the feed roller 29 and the retarding roller 30 is oblique, the manual sheet feed path 45 is smoothly connected to the post-merging vertical path 48. As with the above-described case, the drive gear 43 arranged in the apparatus main body engages the gear train 40 which drives the feed roller 29 of the sheet feeding unit 24, and the feed roller 29 and the like are rotated by the signal from the apparatus main body.

The following effect is obtained by the configurations described above.

When the sheet feeding unit 24 is attached to the apparatus with the parallel path, the direction of the nip line between the feed roller 29 and the retarding roller 30 in the sheet feeding unit 24 becomes substantially in line with the manual sheet feed path 45 and the post-merging parallel path 47. Therefore, even if a thick sheet having high rigidity is separated and fed from the manual sheet feed tray, the sheet is never damaged.

When the same sheet feeding unit 24 is attached to the apparatus with the vertical path, since the direction of the nip line between the feed roller 29 and the retarding roller 30 becomes oblique, the manual sheet feed path 45 is smoothly connected to the post-merging vertical path 48. Therefore, even if a thick sheet having high rigidity is separated and fed from the manual sheet feed tray, the sheet is also never damaged in the case of the apparatus with the vertical path.

Consequently, the sheet feeding unit 24 can be used at the similar separation performance and the similar feed performance, even if the same manual sheet feed tray is attached to the apparatuses in which the sheet conveyance paths are different from each other after the merging.

As described above, according to the first embodiment of the invention, the same sheet feeding unit 24 can be used independently of the sheet conveyance path of the apparatus main body, so that the large number of the same sheet feeding units 24 can be produced and cost reduction of the sheet feeding unit 24 can be realized. Further, the same sheet feeding unit 24 can be used for several generations of the products whose main bodies have different sheet conveyance paths, so that the sheet feeding unit 24 can be reused to improve a reuse property of the sheet feeding unit 24.

Second Embodiment

Figure 10:
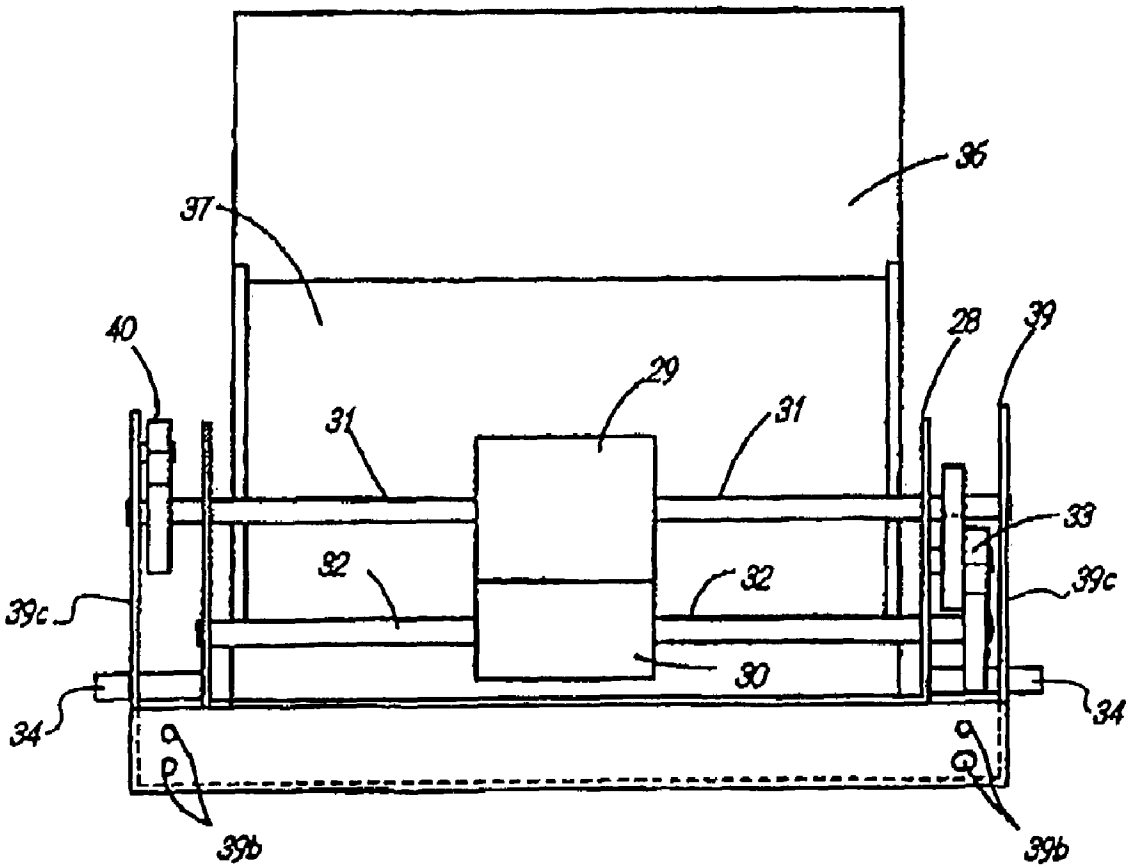
FIG. 10 is a plan view of the sheet feeding unit according to a second embodiment.
Figure 11:
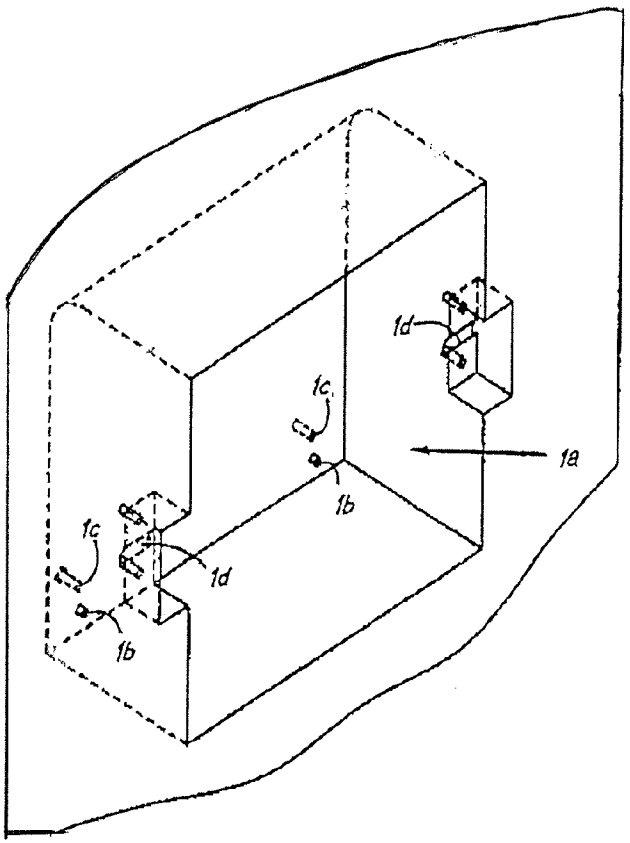
FIG. 11 is a view for explaining the sheet feeding unit attaching configuration of the apparatus main body according to the second embodiment.
Figure 12:
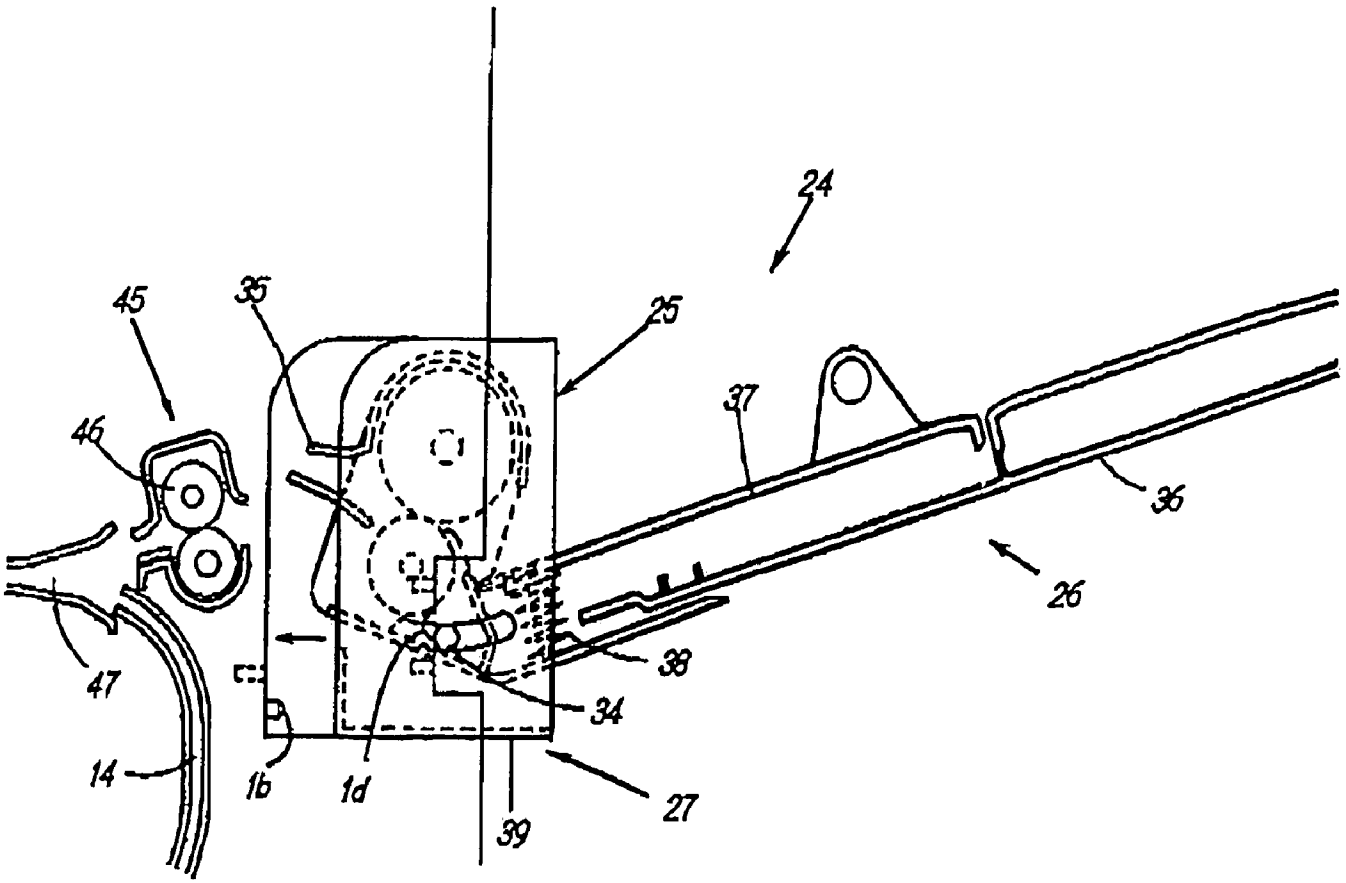
FIG. 12 is a view for explaining the state before the sheet feeding unit according to the second embodiment is attached.
Figure 13:
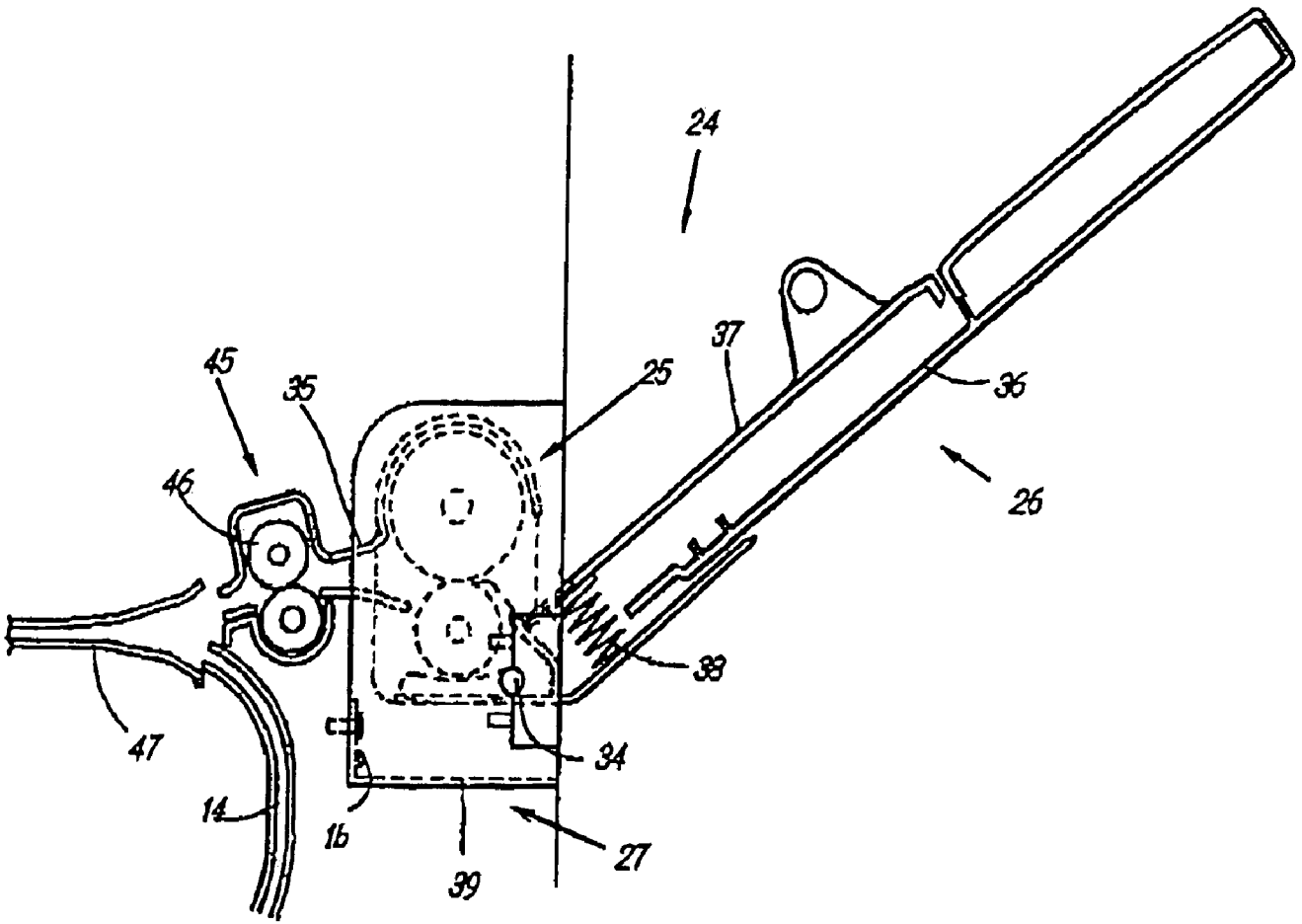
FIG. 13 is a view for explaining the state in which the sheet feeding unit is attached to the parallel path device according to the second embodiment.
Figure 14:
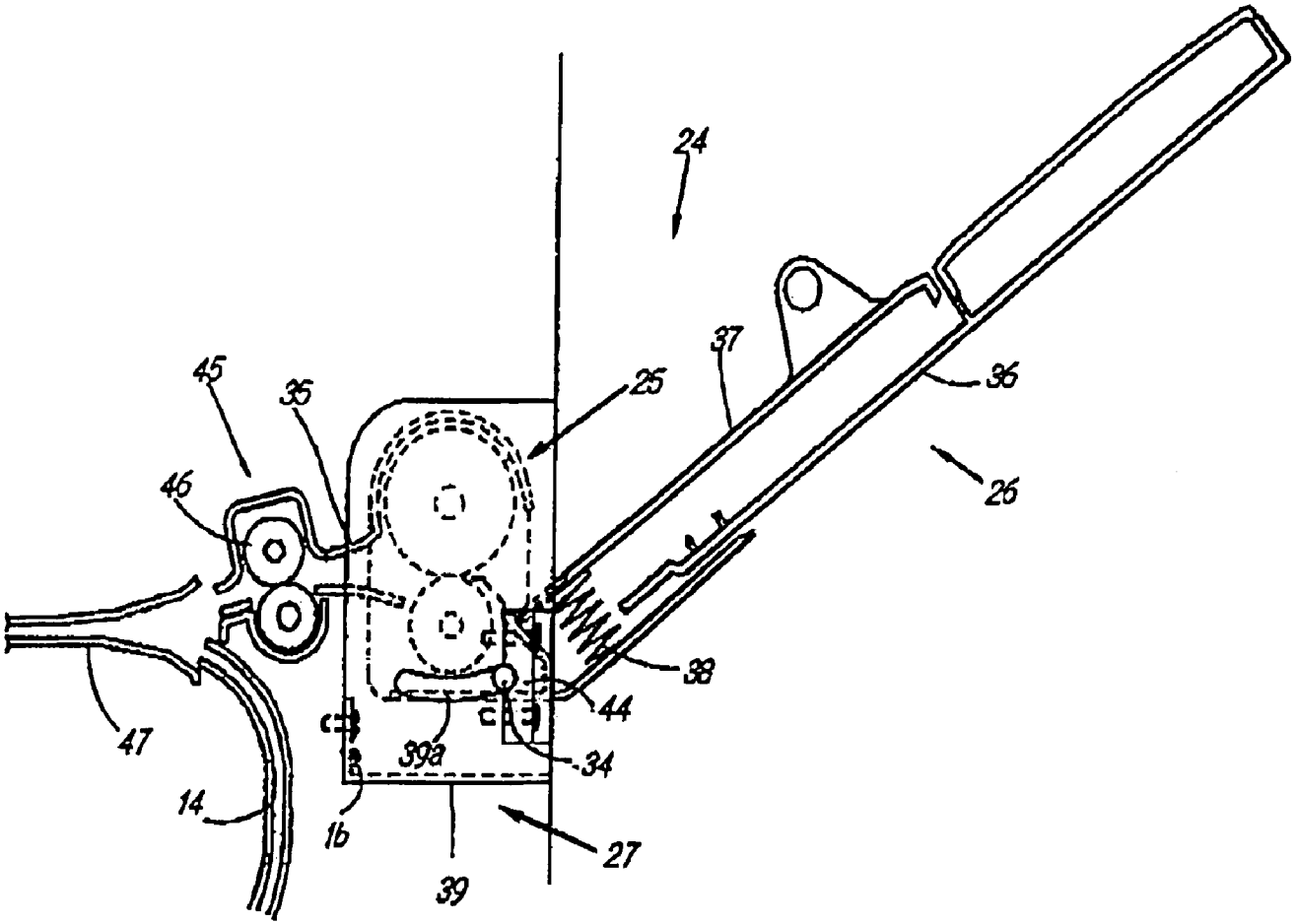
FIG. 14 is a view for explaining the state in which the sheet feeding unit is attached to the parallel path device according to the second embodiment.
Figure 15:
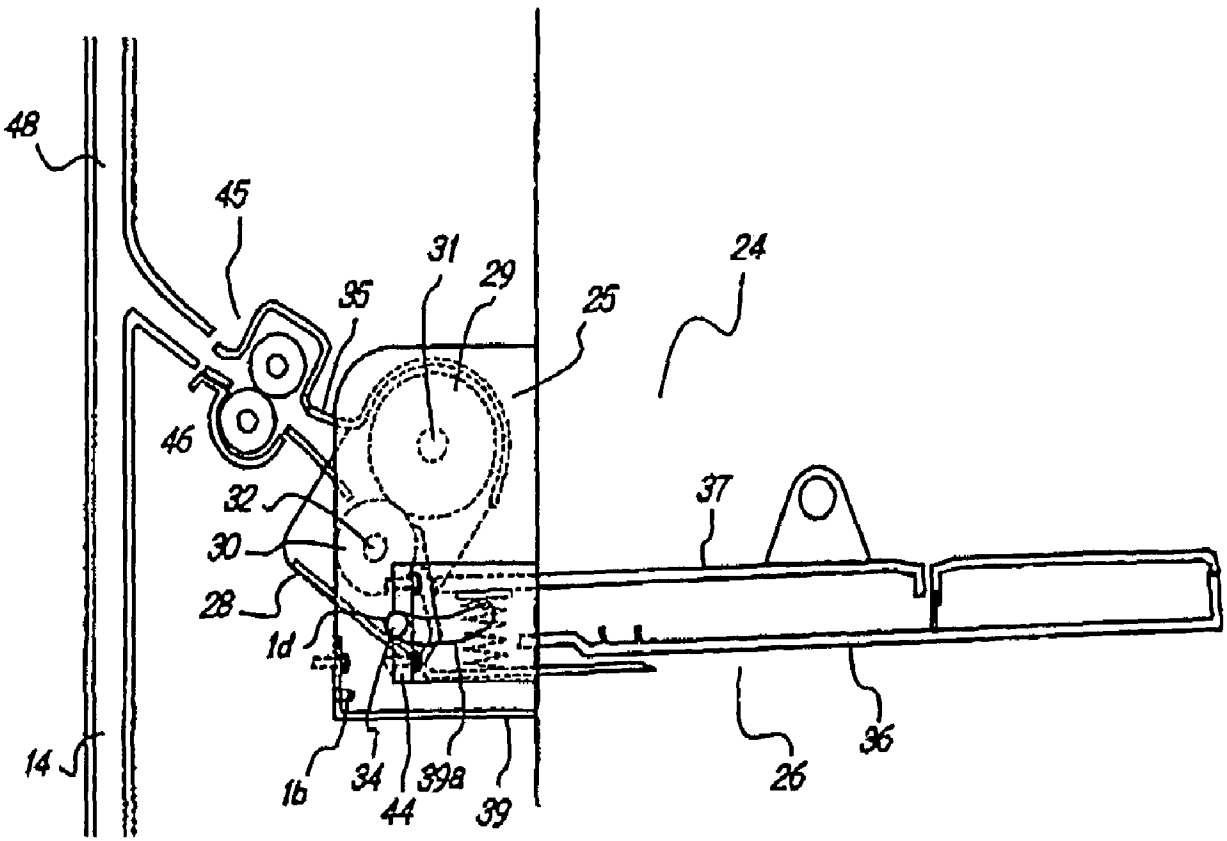
FIG. 15 is a view for explaining the state in which the sheet feeding unit is attached to the vertical path device according to the second embodiment.
Figure 16:
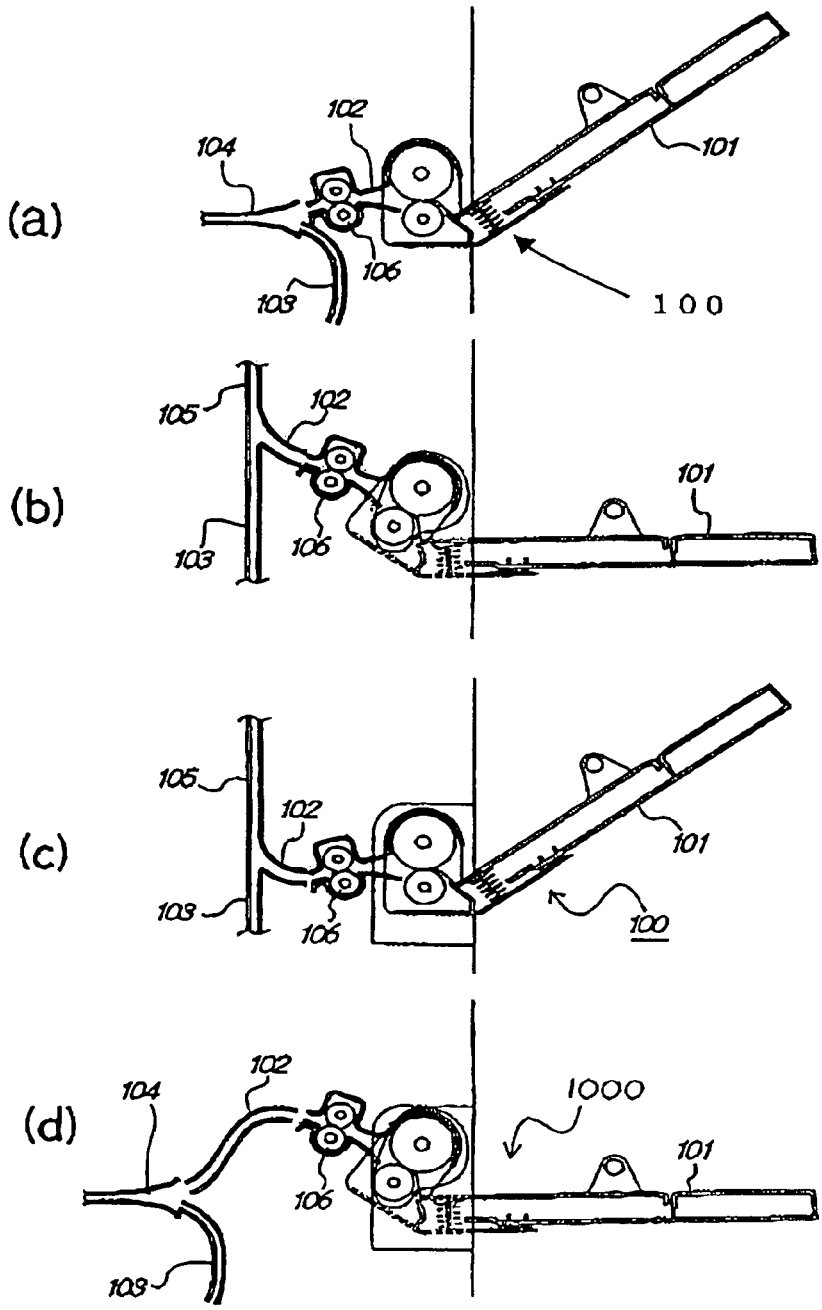
FIGS. 16A to 16D are a sectional view for explaining a problem of the related background art in a manual sheet feed tray.

Referring to FIGS. 10 to 15, a second embodiment of a sheet feeding unit according to the invention will be described. FIG. 10 is a front elevation of the sheet feeding unit according to the second embodiment, FIG. 11 is a view for explaining the sheet feeding unit attaching configuration of the apparatus main body, FIG. 12 is a view for explaining the state before the sheet feeding unit, FIGS. 13 and 14 are a view for explaining the state in which the sheet feeding unit is attached to the parallel path device, and FIG. 15 is a view for explaining the state in which the sheet feeding unit is attached to the vertical path device. The same constituent as the first embodiment is indicated by the same reference numeral and the description is omitted.

Description of Configuration

While the sheet feeding device 25 is fixed to the unit frame 39 in the first embodiment, the second embodiment has the configuration in which the angle of the sheet feeding device 25 is adjusted according to the apparatus main body by attaching sheet feeding means.

As shown in FIG. 10, the fixing pin 34 of the sheet feeding device 25 which is of an example of an abutted portion is projected to the outside of a side plate 39*c* of the unit frame 39 through the slit 39*a* in the side plate 39*c* of the unit frame 39. On the other hand, as shown in FIG. 11, in the apparatus main body, a concave portion id which is of an example of an abutting portion is formed at the position of the apparatus main body corresponding to the fixing pin 34 of the sheet feeding unit 24 when the sheet feeding unit 24 is inserted. As shown in FIG. 14, a pressing member 44 which fixes the fixing pin 34 to the apparatus main body is provided.

Description of Action

The attachment of the sheet feeding unit 24 to the apparatus main body will be described.

The case in which the sheet feeding unit 24 is attached to the apparatus with the parallel path will be described. As shown in FIG. 12, the sheet feeding unit 24 is inserted into an insertion portion of the apparatus main body. Then, the fig pin 34 which is of the abutted portion is guided to a wall surface around the concave portion 1*d* which is of the abutting portion by causing the fixing pin 34 to abut on the wall surface, and the sheet feeding device 25 is rotated as the sheet feeding unit 24 is inserted. As shown in FIG. 13, when the fixing pin 34 of the sheet feeding device 25 intrudes into the concave portion 1*d* of the apparatus main body, the rotation of the sheet feeding device 25 is stopped. When the unit frame 39 is positioned to the apparatus main body by the bosses 1*b*, the sheet feeding unit 24 is fixed to the apparatus main body through the screw holes 1*c* by the screw. In this state, as shown in FIG. 14, the fixing pin 34 is fixed to the apparatus main body by the pressing member 44. At this point, the direction of the nip line between the feed roller 29 and the retarding roller 30 becomes substantially in line with the manual sheet feed path 45 and the post-merging parallel path 47. Further, in this state, the drive gear 43 arranged in the apparatus main body engages the gear train 40 which drives the feed roller 29 of the sheet feeding unit 24, and the feed roller 29 and the like are rotated by the signal from the apparatus main body.

The case in which the sheet feeding unit 24 is attached to the apparatus with the vertical path will be described referring to FIG. 15. The sheet feeding unit 24 is inserted into the insertion portion of the apparatus main body. Then, the fixing pin 34 is guided to the wall surface around the concave portion 1*d* by causing the fixing pin 34 to abut on the wall surface, and the sheet feeding device 25 is rotated as the sheet feeding unit 24 is inserted. When the fig pin 34 of the sheet feeding device 25 intrudes into the concave portion id of the apparatus main body, the rotation of the sheet feeding device 25 is stopped. Then, the sheet feeding unit 24 is fixed to the apparatus main body by the screw, and the feed pin 34 is fixed to the apparatus main body by the pressing member 44. At this point, since the direction of the nip line between the feed roller 29 and the retarding roller 30 is oblique, the post-merging vertical path 48 is smoothly connected. As with the case of the apparatus with the parallel path, the drive gear 43 arranged in the apparatus main body engages the gear train 40 which drives the feed roller 29 of the sheet feeding unit 24, and the feed roller 29 and the like are rotated by the signal from the apparatus main body.

In addition to the effect of the first embodiment, the following effect is obtained by the configuration of the second embodiment. Namely, only by inserting the sheet feeding unit 24 into the apparatus main body, the sheet feeding device 25 is rotated so that the fixing pin 34 of the sheet feeding unit 24 adapts to the concave portion 1*d* provided in the apparatus main body, which adjusts the direction of the nip line between the feed roller 29 and the retarding roller 30. Accordingly, the sheet feeding unit 24 can be into the apparatus main body in a simpler way, and the sheet feeding unit 24 can simply adapt to the different apparatuses.

In the first and second embodiments, the tray unit 26 is integrally fixed to the sheet feeding device 25, and the tray unit 26 and the sheet feeding device 25 are integrally rotated with respect to the frame unit 39. However, the invention is not limited to the configuration described in the first and second embodiments, and it is possible that the tray unit 26 is not integrally fixed to the sheet feeding device 25. For example, it is possible that the tray unit 26 is fixed to the unit frame 39.

In the first and second embodiments, the feed roller 29 is driven by connecting the gear train 40 to the motor 42 which is of the drive source arranged in the apparatus main body. However, the invention is not limited to the configuration described in the first and second embodiments. For example, it is possible that the motor 42 which is of the drive source is provided in the unit frame 39 of the sheet feeding unit 24 and the feed roller 29 is rotated by directly driving the feed roller shaft 31.

In the first and second embodiments, the sheet feeding device 25 is rotated about the feed roller shaft 31. However, it is possible that the sheet feeding device 25 is rotated about the axis parallel to the feed roller shaft 31. For example, it is possible that the sheet feeding device 25 is freely rotated with respect to the unit frame 39 about the retarding roller shaft or about the rotating axis different from the roller shafts provided in the sheet feeding device 25.

In the first and second embodiments, the case in which feed roller and the retarding roller are used is illustrated as the configuration for feeding the sheet in the sheet feeding device. However, the invention is not limited to the configuration described in the first and second embodiments. For example, it is possible to form a mechanism in which the sheet is separated and fed one by one by the feed roller and a separation piece (separating member) which is provided opposite to the feed roller and pressed against the feed roller. In the case of the mechanism in which the sheet is separated and fed one by one by the separation piece which is of the opposing member provided opposite to the feed roller, the feed roller and the separation piece are formed to be integrally rotatable with respect to the unit frame of the sheet feeding unit so that the sheet feeding direction from the feed roller can be changed. Then, the feed roller and the separation piece are fixed to the unit frame by the fix portion which can fix the integrally rotating feed roller and separation piece to the unit frame at an arbitrary rotating angle or a predetermined rotating angle. The feed roller and the separation piece can be fixed with the fixing portion by adjusting the feed roller and the separation piece at the rotating angle according to the conveyance path of the apparatus main body.

The invention can also be applied to the case in which the conveyance roller pair, which conveys the sheet after the sheets stacked on the sheet stacking tray are separated one by one by the separation portion, is provided as the sheet feeding portion in the sheet feeding unit. Namely, the conveyance roller pair is formed by the conveyance roller which is of a sheet feeding rotating member and opposing roller which is of an opposing member provided opposite to the conveyance roller. The conveyance roller pair is provided so as to be integrally rotated with respect to the sheet feeding unit. The direction of the nip line of the conveyance roller pair is formed so as to be able to be changed by rotating the conveyance roller pair with respect to the unit frame of the sheet feeding unit. The angle of the nip line of the conveyance roller pair is formed to be able to be changed, which enables sheet feeding direction from the sheet feeding unit to the apparatus main body to be changed.

In the sheet feeding unit according to the first and second embodiments, since the sheet feeding portion can be fixed at the arbitrary angle or the predetermined angle, the same sheet feeding unit can be used independently of the sheet conveyance path of the apparatus main body. Therefore, the large number of the same sheet feeding units can be produced and cost reduction of the sheet feeding unit can be realized. Further, the same sheet feeding unit can be used for several generations of the products whose main bodies have different sheet conveyance paths, so that the sheet feeding unit can be reused to improve the reuse property of the sheet feeding unit.

The sheet feeding unit according to the second embodiment is formed so that the angle of the sheet feeding portion is adjusted to the angle corresponding to the apparatus main body only by attaching the sheet feeding unit to the apparatus main body. Therefore, the same sheet feeding unit can be simply attached to the different apparatus.

This application claims priority from Japanese Patent Application No. 2004-015231 filed Jan. 23, 2004, which is hereby incorporated by reference herein.

What is claimed is:

1. A sheet feeding unit comprising:

a unit frame;

a sheet stacking tray which is held in the unit frame;

a sheet feeding rotating member which feeds the sheet stacked on the sheet stacking tray; and a separating member which is provided opposite to the sheet feeding rotating member, wherein the sheet feeding rotating member and the separating member are integrally pivotably supported on the unit frame, and wherein a pivot of the sheet feeding member and the separating member is the rotating axis of the sheet feeding rotating member.

2. A sheet feeding unit according to claim 1, wherein the sheet feeding rotating member and the separating member are fixed to the unit frame at an arbitrary angle with respect to the unit frame.

3. A sheet feeding unit according to claim 1, wherein the sheet feeding rotating member and the separating member are fixed to the unit frame at a predetermined angle with respect to the unit frame.

4. A sheet feeding unit according to claim 1, wherein the sheet stacking tray and the sheet feeding rotating member are integrally pivotably supported on the unit frame.

5. A sheet feeding unit according to claim 1, further comprising a gear which transmits drive for rotating the sheet feeding rotating member, and wherein the gear is connected to a drive transmission gear that is provided in the apparatus main body when the sheet feeding unit is attached to the apparatus main body.

6. A sheet feeding unit according to claim 1, wherein the sheet feeding unit can be attached to a plural type of a apparatus main body, and wherein the sheet feeding device is held at an angle with respect to the unit frame according to each type of the apparatus main body.

7. An image forming apparatus comprising:

a sheet feeding unit according to claim 1;

an apparatus main body to which the sheet feeding unit is attached; and an image forming unit which is provided in the apparatus main body, the image forming unit forming an image on a sheet fed by the sheet feeding unit.

* * * * *

UNITED STATES PATENT AND TRADEMARK OFFICE

CERTIFICATE OF CORRECTION

PATENT NO. : 7,277,668 B2
APPLICATION NO. : 11/038207
DATED : October 2, 2007
INVENTOR(S) : Ryuichi Kojima It is certified that error appears in the above-identified patent and that said Letters Patent is hereby corrected as shown below:

ON THE TITLE PAGE:
At Item (57), Abstract, Line 6, “a” should read --an--.

COLUMN 1:
Line 18, “sheet” should read --sheets--.
Line 39, “sheet” should read --sheets--.

COLUMN 2:
Line 19, “is” (second occurrence) should read --be--.
Line 37, “which” should be deleted.

COLUMN 3:
Line 16, “a sectional view” should read --sectional views--.

COLUMN 4:
Line 21, “front elevation” should read --plan views--.

COLUMN 5:
Line 32, “42, are” should read --42 are--.
Line 55, “Alight” should read --A light--.

COLUMN 6:
Line 33, “Attachment” should read --attachment--.
Line 44, “fame” should read --frame--.
Line 47, “a” (second occurrence) should read --an--.

COLUMN 7:
Line 21, “description” should read --description of--.

COLUMN 8:
Line 10, “front elevation” should read --plan view--.
Line 32, “portion id” should read --portion 1d--.
Line 44, “fig” should read --fixing--.

UNITED STATES PATENT AND TRADEMARK OFFICE

CERTIFICATE OF CORRECTION

PATENT NO. : 7,277,668 B2
APPLICATION NO. : 11/038207
DATED : October 2, 2007
INVENTOR(S) : Ryuichi Kojima It is certified that error appears in the above-identified patent and that said Letters Patent is hereby corrected as shown below:

COLUMN 9:
Line 6, "fig" should read --fixing--.
Line 8, "portion id" should read --portion 1d--.
Line 11, "feed" should read --fixing--.
Line 29, "be" should read --be inserted--.

COLUMN 10:
Line 7, "fix" should read --fixing--.

Signed and Sealed this

Thirteenth Day of May, 2008

JON W. DUDAS
*Director of the United States Patent and Trademark Office*